US008783981B2

(12) United States Patent
Watson et al.

(10) Patent No.: US 8,783,981 B2
(45) Date of Patent: Jul. 22, 2014

(54) COLLAPSABLE CORE FOR PRINTER

(75) Inventors: Jan Watson, Miamisburg, OH (US); Thomas P. Keller, Mesa, AZ (US)

(73) Assignee: Avery Dennison Corporation, Glendale, CA (US)

( * ) Notice: Subject to any disclaimer, the term of this patent is extended or adjusted under 35 U.S.C. 154(b) by 256 days.

(21) Appl. No.: 13/212,667

(22) Filed: Aug. 18, 2011

(65) Prior Publication Data

US 2012/0045266 A1 Feb. 23, 2012

Related U.S. Application Data

(60) Provisional application No. 61/375,574, filed on Aug. 20, 2010.

(51) Int. Cl.
*B41J 15/02* (2006.01)
*B65H 75/24* (2006.01)

(52) U.S. Cl.
CPC ..... *B41J 15/02* (2013.01)
USPC ..... 400/242; 400/223; 242/571

(58) Field of Classification Search
CPC ..... B41J 5/02; B56H 75/24
USPC ..... 400/223, 242; 242/571
See application file for complete search history.

(56) References Cited

U.S. PATENT DOCUMENTS 3,433,355 A * 3/1969 Smith ..... 242/571
3,815,840 A * 6/1974 Horton et al. ..... 242/571
4,711,406 A * 12/1987 Barstow ..... 242/572
5,657,066 A * 8/1997 Adams et al. ..... 347/198
5,788,384 A * 8/1998 Goodwin et al. ..... 400/208
5,833,377 A 11/1998 Keller et al.
5,904,315 A * 5/1999 McInerney ..... 242/571
5,947,618 A 9/1999 Keller et al.
7,036,766 B2 * 5/2006 Place et al. ..... 242/609.1
7,093,786 B2 * 8/2006 Wisniewski ..... 242/571
7,350,462 B2 4/2008 Akiyama
7,350,992 B2 4/2008 Ward
8,029,201 B2 * 10/2011 Chen ..... 400/242
8,424,796 B2 * 4/2013 Witwer et al. ..... 242/608.6

(Continued)

FOREIGN PATENT DOCUMENTS

JP 62111856 A * 5/1987 ..... B41J 15/16
JP 63165257 A * 7/1988 ..... B41J 15/16

(Continued)

*Primary Examiner* — Nguyen Ha
(74) *Attorney, Agent, or Firm* — Avery Dennison Corporation

(57) ABSTRACT

The present invention provides a reusable and collapsible take-up core for a printer. The core is generally a hollow member having an interior bored mated to fit over a spindle. The core comprises a wall having an interior and exterior surface, at least one axially extending ridge formed on the interior surface of the wall of the core, and an axially extending relief groove formed on the exterior surface of the wall of the core. The take-up core of the present invention provides a more efficient, less time consuming, less messy method and device for unrolling the used or spent material off the core. A method for discarding spent material (i.e. release liner) from a core of a take-up assembly of a printer is also provided.

15 Claims, 8 Drawing Sheets

(56) References Cited

U.S. PATENT DOCUMENTS

| | | | | |
|---|---|---|---|---|
| 2003/0106957 | A1* | 6/2003 | Seybold et al. | 242/611.2 |
| 2005/0145746 | A1* | 7/2005 | Place | 242/577 |
| 2007/0059079 | A1* | 3/2007 | Silverbrook et al. | 400/614 |
| 2007/0059080 | A1* | 3/2007 | Silverbrook et al. | 400/614 |
| 2007/0059081 | A1* | 3/2007 | Silverbrook et al. | 400/614 |
| 2008/0135672 | A1* | 6/2008 | Fabian | 242/571 |
| 2009/0072073 | A1 | 3/2009 | Campbell et al. | |

FOREIGN PATENT DOCUMENTS

| | | | | | |
|---|---|---|---|---|---|
| JP | 06127064 | A | * | 5/1994 | B41J 17/22 |
| JP | 08225200 | A | * | 9/1996 | B41J 15/16 |
| JP | 11079480 | A | * | 3/1999 | B41J 15/02 |
| JP | 11171375 | A | * | 6/1999 | B65H 75/24 |
| JP | 2001088990 | A | * | 4/2001 | B41J 15/16 |
| JP | 2003002542 | A | * | 1/2003 | B65H 75/10 |
| JP | 2006225136 | A | * | 8/2006 | B41J 15/02 |
| JP | 2007112585 | A | * | 5/2007 | B65H 75/12 |

* cited by examiner

COLLAPSABLE CORE FOR PRINTER

CROSS-REFERENCE TO RELATED APPLICATION(S)

The present application claims priority from U.S. Provisional Application No. 61/375,574 filed Aug. 20, 2010, which is incorporated by herein by reference in its entirety.

FIELD OF THE INVENTION

The present inventive subject matter relates generally to the art of electronic printers. Particular relevance is found in connection with table top printers such as thermal label printers, in which a release liner, ink ribbon or other material is to be collected post processing and removed and accordingly the present specification makes specific reference thereto.

BACKGROUND OF THE INVENTION

Printers are known in the art to include spindles to hold rolls of web material that are wound on hollow tubular cores that are removably received on the spindles. For example, a roll of ink ribbon may be supplied on such a core which is mated to and removably held on its particular spindle. Similarly, a second core which is mated to and removably held on its particular spindle may be provided to take up the used ink ribbon by winding the used ribbon on the core.

A spindle may also be provided to supply print media from a roll of media wound on a mated core received over and removably held on the spindle. For example, the print media may be a roll of label stock or other suitable print media wound on the media supply core. Commonly, the label stock may include a series of individual labels or record members releasably adhered via a pressure sensitive adhesive or the like to a release liner or similar continuous web of material. In general, the print media is unwound from the supply core and routed or passed between a platen roller and a printhead, e.g., a thermal printhead, which selectively marks the media. Thereafter, the label is dispensed from the printer or otherwise removed from the liner. As successive labels are dispensed from the printer, an amount of spent liner (i.e., the portion of the liner with the labels removed) accumulates. Optionally, the spent liner may be taken up and/or wound on a second liner take-up core removably held on a mated spindle.

Printers employing various spindles and cores are disclosed in U.S. Pat. Document Nos. 5,833,377; 5,947,618; 7,350,462; 7,350,992 and 2009/072073, all of which are incorporated by reference herein in their entirety.

Typically, the core of the printer that takes-up spent or used material will have a limited capacity for receiving that material, be it spent liner or used ink ribbon or the like. Accordingly, when a take-up core is full, it is removed from its spindle. To continue operation of the printer, the removed take-up core has to be replaced on its spindle. In one option, the removed take-up core may be disposed of or thrown away along with the spent or used material wound thereon and an entirely new take-up core can be used to replace it. This option, however, can be wasteful.

Alternately, the used or spent material wound or otherwise accumulated on the take-up core can be removed therefrom and the same take-up core, which is now empty, can be returned to its spindle. While this later approach may be desirable insomuch as the core can be reused, it presents some challenges. In particular, removing the used or spent material from the core can be burdensome. On one hand, when the material is tightly wound on the core it may be difficult to axially slide or otherwise remove the roll of material off an end of the core. On the other hand, with such tightly wound material, it can be time consuming, messy and/or otherwise undesirable to unroll the used or spent material off the core.

Accordingly, a new and/or improved reusable take-up core is disclosed which addresses the above-referenced problem(s) and/or others.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

In accordance with one embodiment, a reusable take-up core as essentially described herein is provided. More specifically, the present invention provides a reusable and collapsible core for a printer. The core includes a hollow member that has a bore which is suited for a spindle. The core has a wall with an interior and an exterior surface, an extending ridge formed on the interior surface of the wall and an extending relief groove formed on the exterior surface of the wall of the core.

The present invention also discloses a method of discarding spent material from a core of a take-up assembly of a printer. The method includes the steps of initially separating the spent material wound on the core from any remaining portion of the material in a printer. Then, the core is taken off of a spindle, and a force is applied to a portion of the circumference of the core, so as to be able to remove the spent material from the core. Finally, the force on the core is released, and the core can be replaced back on the spindle.

Numerous advantages and benefits of the inventive subject matter disclosed herein will become apparent to those of ordinary skill in the art upon reading and understanding the present specification.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

The apparatuses and methods disclosed in this document are described in detail by way of examples and with reference to the FIGURES. Unless otherwise specified, like numbers in the FIGURES indicate references to the same, similar, or corresponding elements throughout the FIGURES. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to FIGURES. For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the preferred embodiment(s) presented herein.

Figure 1:
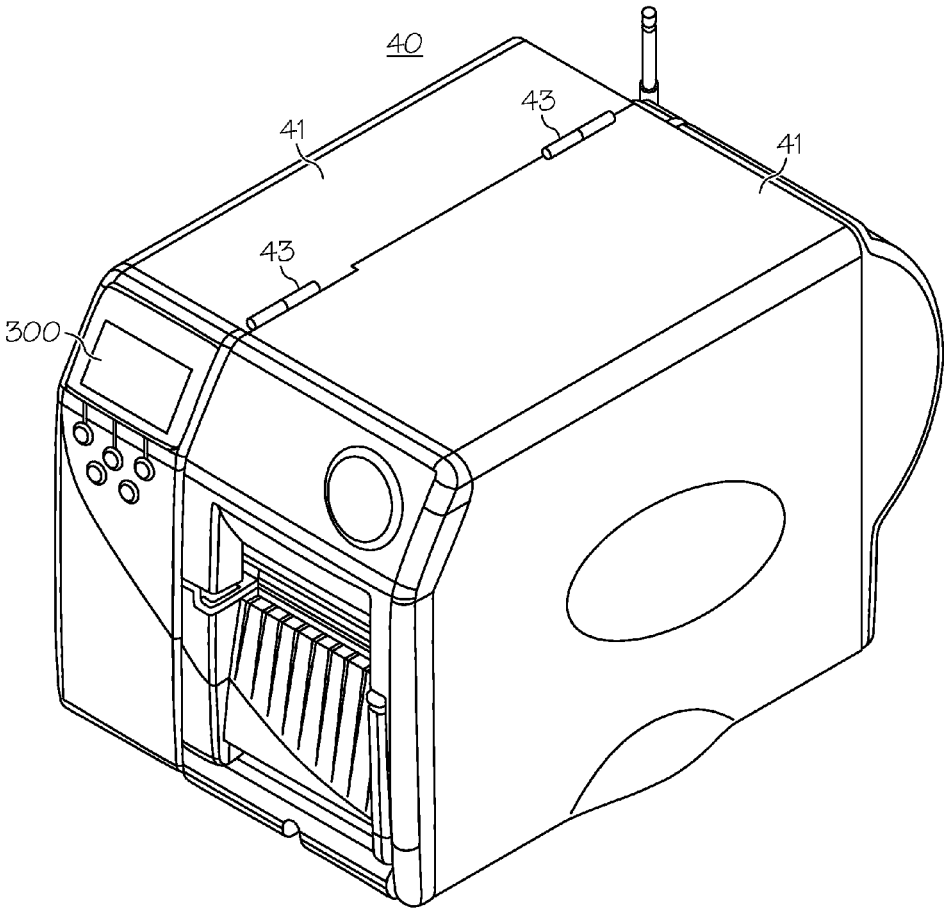
FIG. 1 is a diagrammatic illustration of a thermal label printer in accordance with aspects of the present inventive subject matter.
Figure 2:
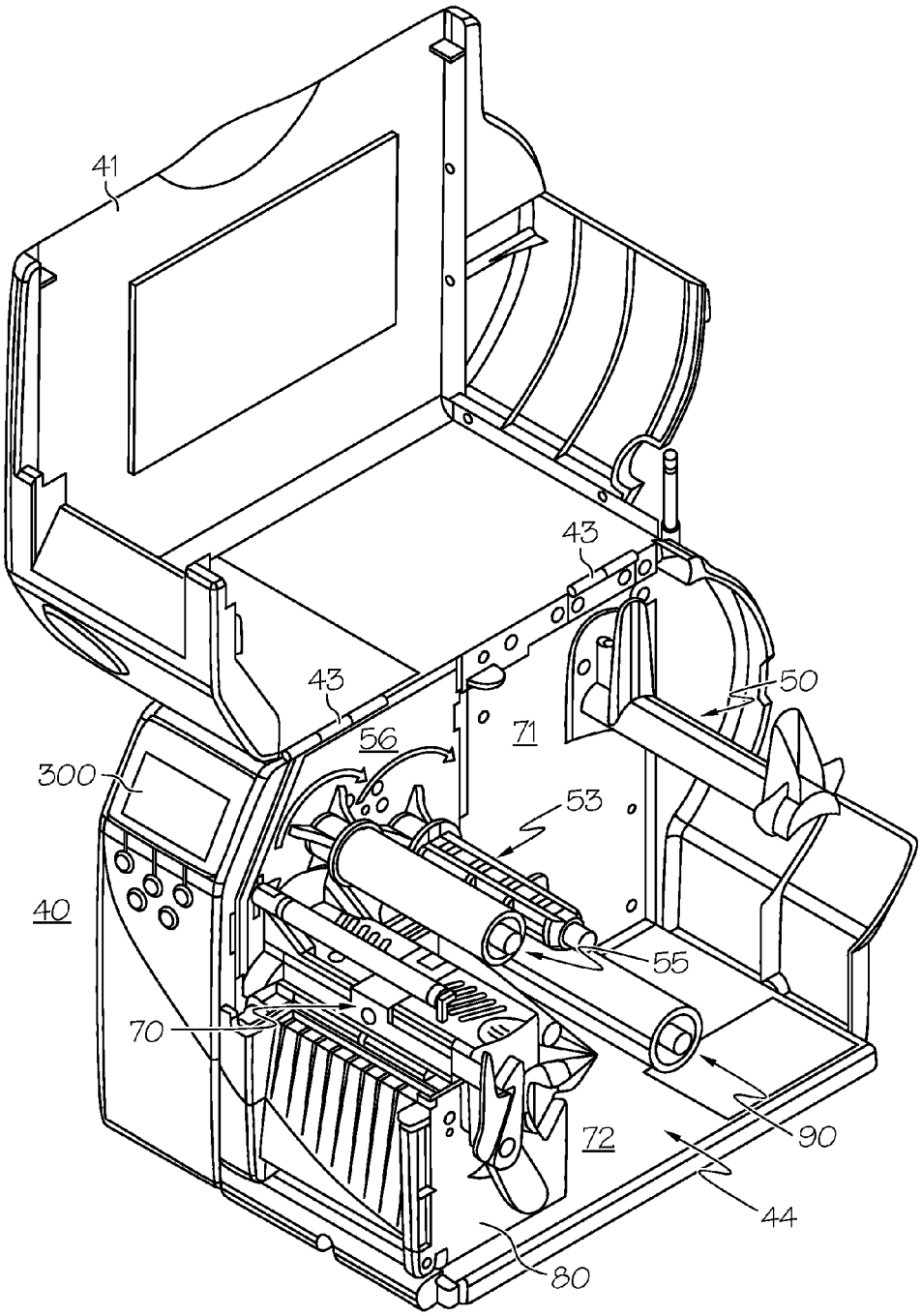
FIG. 2 shows the printer of FIG. 1 having an outer housing opened to reveal internal components of the printer, including a spent liner take-up assembly mounted in cantilevered fashion to a frame of the printer.

With reference now to FIGS. 1 and 2, there is shown a thermal label printer generally indicated at 40 having a two piece housing 41 pivotally joined together at hinges 43. The printer 40 also includes a frame 44 to which the housing 41 is mounted. A roll "R" of label stock or other suitable print media, e.g. paper, film, foil, etc. (see FIG. 3) is held by the media supply roll mounting assembly 50 that is mounted on a vertical wall 71 of the frame 44. For example, the label or printable stock may include a series of individual labels or record members (abstractly depicted in FIG. 3 by the dotted line identified with the reference character RM) or may simply be a continuous supply of material with no delineations between areas to be printed, releasably adhered via a pressure sensitive adhesive or the like to a continuous release liner (abstractly depicted in FIG. 3 by the dashed line identified with the reference character L) or other similar continuous web of material. In any event, the print media is supplied from the roll R held by the media supply roll mounting assembly 50 to a printhead assembly 70 for marking by a thermal printhead included in the assembly 70.

FIG. 2 also shows: an ink ribbon supply spindle 53 for holding a roll of thermal ink ribbon (not shown) from which the ribbon is supplied to the thermal printhead of the printhead assembly 70; and, an ink ribbon take-up spindle 55 for receiving and holding a roll of the spent or used ink ribbon. FIG. 2 further shows a selectively pivotable mounting member 56 to which the spindles 53 and 55 are mounted in a cantilevered fashion. Further, the printhead assembly 70 also includes the thermal printhead which is mounted in a cantilevered fashion to the mounting member 56. As shown, the selectively pivotable mounting member 56 is positioned upright or vertically, i.e., in the operating position. To facilitate loading and/or threading of the print media and/or ink ribbon between the thermal printhead of the assembly 70 and a cooperating platen roller rotatably mounted to a bracket 80 secured to a floor 72 of the frame 44, the mounting member 56 is selectively tilted back from the upright position thereby raising the cantilevered printhead assembly 70 away from the platen roller.

Suitably, the print media is routed and/or guided along a path from the roll R carried by the media supply roll mounting assembly 50 to the printhead assembly 70 where it passes (along with an optional ink ribbon from the ink ribbon supply spindle 53) between the thermal printhead of the printhead assembly 70 and the cooperating platen roller. As can be appreciated, the printhead selectively marks the media (e.g., the label or record member "RM" carried on the liner "L"), and thereafter, the printed label or record member RM is dispensed from the printer 40 or otherwise removed from the liner L. As successive labels or record members RM are dispensed from the printer 40, an amount of spent liner L (i.e., the portion of the liner L with the labels or record members RM removed) accumulates. As shown, the spent liner L is taken up by a spent liner take-up assembly 90 mounted in cantilevered fashion to the vertical wall 71 of the frame 44.

Figure 4:
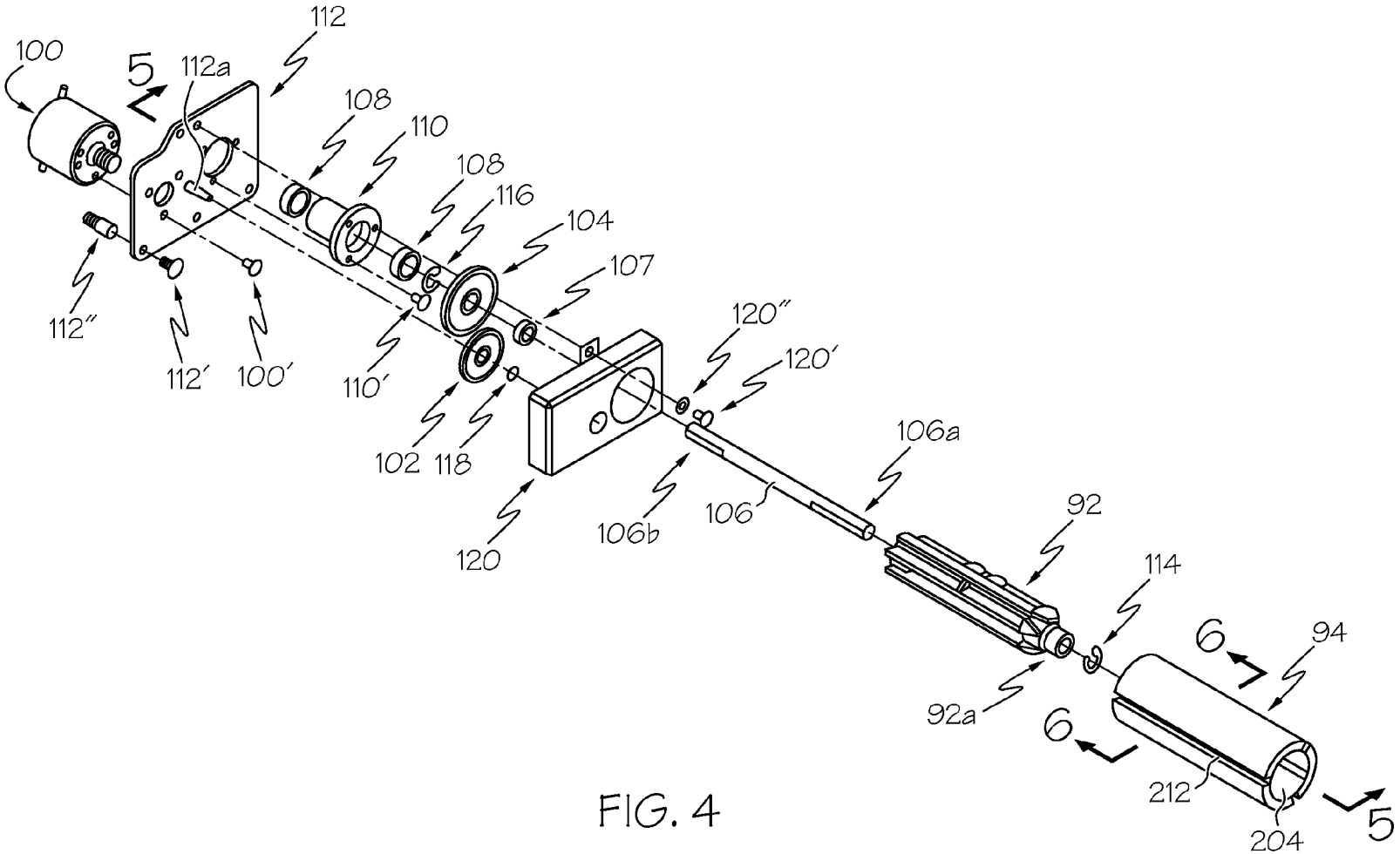
FIG. 4 is a diagrammatic illustration showing an exploded view of the spent liner take-up assembly illustrated in FIG. 2.
Figure 5:
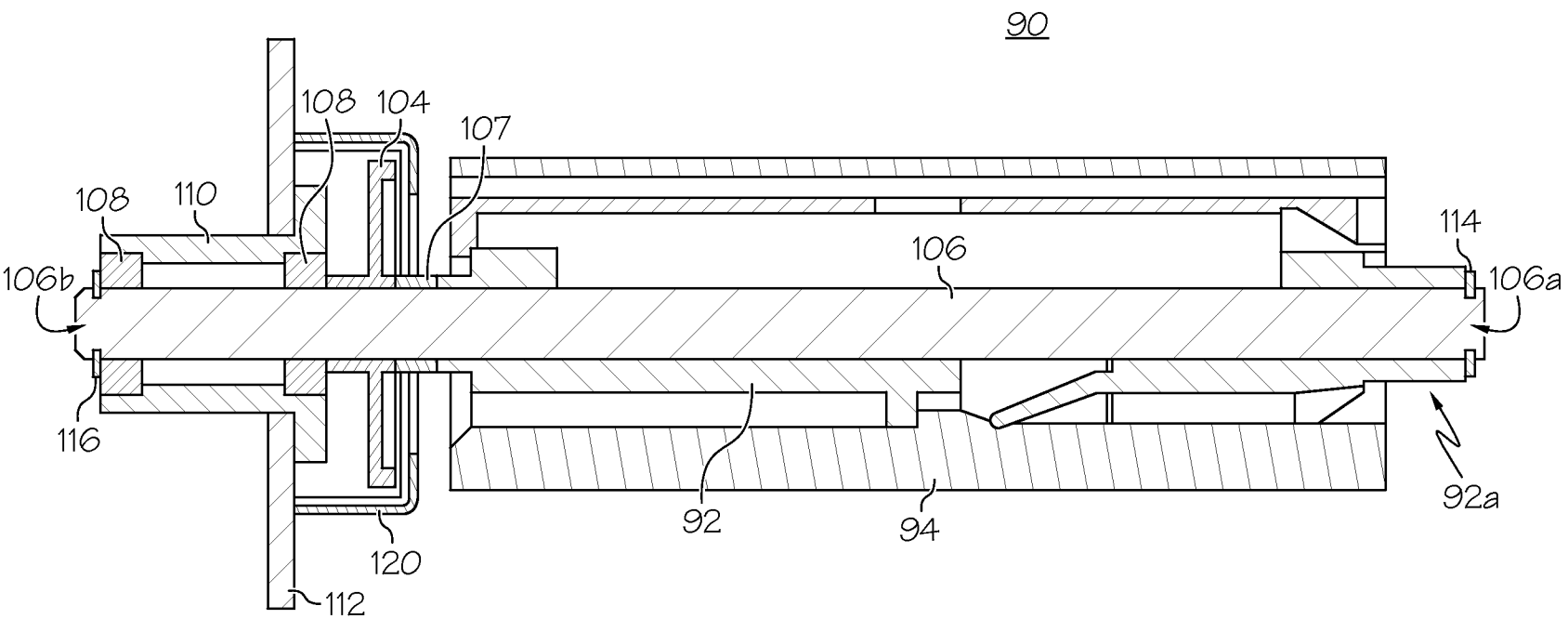
FIG. 5 is a diagrammatic illustration showing an unexploded longitudinal cross section view of the spent liner take-up assembly illustrated in FIG. 4 taken along section line A-A.

With added reference now to FIGS. 4 and 5, the liner take-up assembly 90 includes a spent liner take-up spindle 92 and a spent liner take-up core 94. In general, the core 94 is a hollow tubular or cylindrical member having an interior bore mated to fit over the spindle 92 so as to be removably held thereby. The core 94 is selectively mounted on the spindle 92 by axially sliding the core 94 over the free end 92*a* of the spindle 92 and may be selectively removed from the spindle 92 by axially sliding the core 94 off of the free end 92*a* of the spindle 92.

As shown, in FIGS. 4 and 5, the liner take-up assembly 90 further includes an electric motor 100 which rotatably drives the spindle 92 about its central axis via cooperative gears 102 and 104 operatively coupled to a shaft 106 axially extending through the spindle 92. At least one flattened surface on the end 106*a* of the shaft 106 cooperates with a mated inner surface formed on the spindle 92 so that the spindle 92 rotates in unison with the shaft 106. The other end 106*b* of the shaft 106 extends through a spacing ring 107 and a hub of the gear 104 to be received in a pair of bearings 108 fitted in a bearing housing 110 which is secured to a bracket 112, e.g., by one or more screws 110'. At the first end 106*a* of the shaft 106, a first retaining clip or e-ring 114 secured to the shaft 106 retains the spindle 92 on the shaft 106. At the second end 106*b* of the shaft 106, a second retaining clip or e-ring 116 secured to the shaft 106 retains the shaft 106 within the bearings 108.

As shown, the gear 102 is rotatably retained on a post 112*a* extending from the bracket 112 by a retaining clip 118. On an opposite side, the motor 100 is also secured to the bracket 112, e.g., by one or more screws 100'. To protect the gear train and inner works of the liner take-up assembly 90, a housing 120 which covers the gear train and inner works is also secured to the bracket 112, e.g., via one or more screws 120' and corresponding lockwashers 120". Suitably, the liner take-up assembly 90 is mounted to the vertical wall 71 of the frame 44 via one or more screws 112' and corresponding standoffs 112" that secure the bracket 112 to the vertical wall 71 of the frame 44. In operation, the motor 100 selectively rotates the gear 102 about the post 112*a*, which in turn rotates the gear 104 having the shaft 106 received in its hub. That in turn rotates the shaft 106 about its axis within the bearings 108, which in turn rotates the spindle 92 retained on the shaft 106, which in turn rotates the core 94 held on the spindle 92, which in turn winds the spent liner L onto the core 94.

Figure 6:
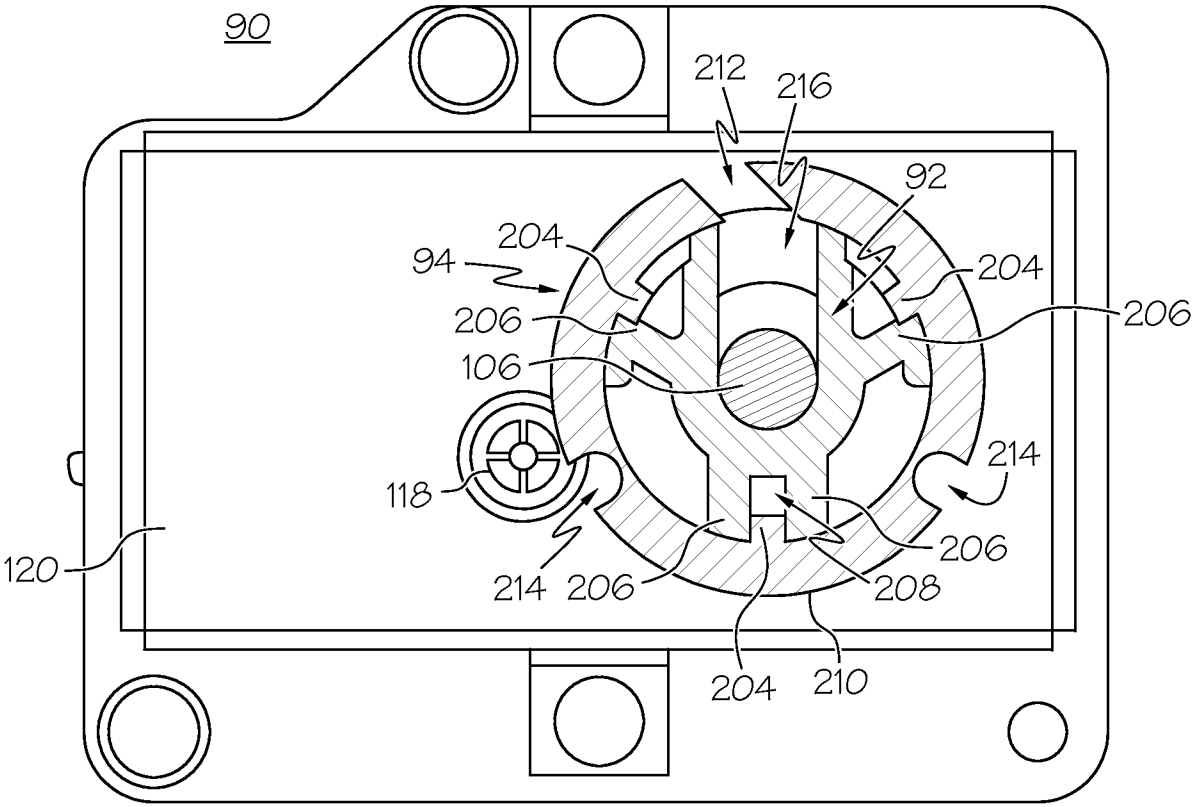
FIG. 6 is a diagrammatic illustration showing an unexploded axial cross section view of the spent liner take-up assembly illustrated in FIG. 4 taken along section line B-B.
Figure 7:
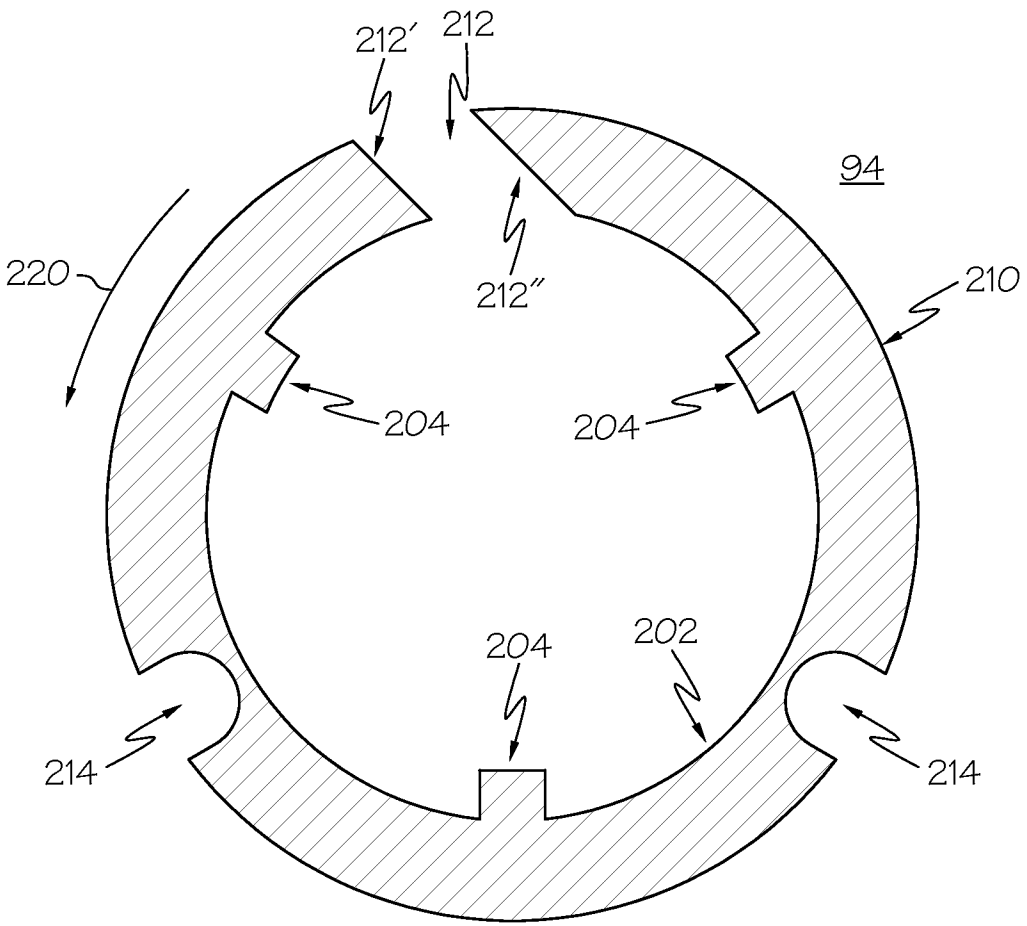
FIG. 7 is a diagrammatic illustration showing an axial cross section view of the of the spent liner take-up core illustrated in FIG. 4 taken along section line B-B.

With additional reference now to FIGS. 6 and 7, an inner surface 202 of the core 94 is provided with one or more axially extending ridges 204 that protrude radially inward from the wall of the core 94, and the spindle 92 has a plurality of axially extending ribs 206 that protrude radially outward. Optionally, as shown, at least one pair of these ribs 206 forms an axially extending channel 208 therebetween. Suitably, the ridges 204, ribs 206 and/or channels 208 extend the entire or nearly the entire axial length of the core 94 and/or spindle 92. In any event, one or more of the ridges 204 formed on an interior of the core 94 cooperate with one or more ribs 206 and/or channels 208 formed on an exterior of the spindle 92 so that, when the core 94 is installed on the spindle 92, the core 94 will rotate in unison with the spindle 92. In the illustrated embodiment, at least one ridge 204 is received in the channel 208 so that the core 94 is not free to rotate independently about the spindle 92 but rather rotates in unison with the spindle 92.

Suitably, the core 94 is formed of a suitably deformable resilient plastic or other sufficiently deformable resilient material. Accordingly, when removed from the spindle 92, the core 94 may be selectively collapsed or deformed axially, i.e., the outer circumference or periphery 210 may be selectively reduced. Consequently, when collapsed, accumulated liner wound around the outer circumference or periphery 210 of the core 94 can be easily slid in an axial direction off an end of the core 94. To accommodate the collapsing of the core 94, a gap or slot 212 is formed in the wall of the core 94. As shown, the gap or slot 212 extends entirely through the wall of the core 94 and runs the entire axial length of the core 94 (see also FIG. 4). When the core 94 is squeezed or deformed about its outer circumference or periphery 210 (e.g., by the squeezing grasp of a user or other application of radially inward force), the wall of the core 94 deforms so that the gap or slot 212 is substantially closed or reduced thereby reducing the outer circumference or periphery 210 of the core 94. Suitably, the axial length of the core 94 is longer than the width of the liner or other material wound thereon so that a user may indeed selectively grasp and/or squeeze an exposed portion or end of the core 94. As the core 94 is formed from sufficiently resilient plastic or other suitably resilient material, upon release or cessation of the radially inward application of force, the core 94 returns to its otherwise normal state, i.e., the core 94 springs back so that the outer circumference and/or periphery 210 is essentially restored to its usual dimension.

In the illustrated embodiment, to enhance the flexibility of the core 94, one or more axially extending relief grooves 214 are formed on an exterior surface of the wall of the core 94. Suitably, the grooves 214 extend the entire or nearly the entire axial length of the core 94. The grooves 214 result in a corresponding thinning of the wall of the core 94 adjacent the location of the grooves 214 and consequently the wall of the core 94 is relatively more flexible at these points as compared to thicker portions of the core wall. That is, as the gap 212 is collapsed, grooves 214 expand so as to allow the material of the core collapse substantially equally around the diameter of the core. The slot or gap 212 and grooves 214 are disposed substantially equally around the circumference of the core such that there is roughly and equal space between each of the gap and grooves.

As can be appreciated, when the spent liner or other material is being wound onto the core 94, depending upon how tightly the material is being wound, the core 94 may experience a radially inward application of force which would otherwise tend to collapse the core 94. However, as shown in FIG. 6, when the core 94 is on the spindle 92, the ribs 206 of the spindle 92 contact and/or about the inner surface 202 of the core 94. Suitably, the ribs 206 are sufficiently strong, stiff and/or rigid enough to counter the aforementioned force and protect against the unwanted collapse of the core 94 under these circumstances.

Turning now to the operation of the device in one exemplary embodiment, an empty core 94 is initially placed on the spindle 92 so that the gap or slot 212 aligns with an axially extending trench or trough 216 formed in the spindle 92. Suitably, the trough 216 extends the entire or nearly the entire axial length of the spindle 92. Optionally, the core 94 will only properly slide onto and/or fit over the mated spindle 92 in one particular relative rotational orientation, i.e., so that the gap or slot 212 does indeed align with the trough 216. For example, optionally, the ridges 204 on the inner surface 202 of the core 94 and the ribs 206 and channels 208 on an exterior of the spindle 92 are located circumferentially about their respective parts to ensure the proper orientation. For example, the core 94 and spindle 92 may be formed so that the respective ridges 204 and the ribs 206 and channels 208 only properly align relative to one another when the core 94 and spindle 92 have the correct rotational orientation relative to one another. Alternately, the width or other dimension of one particular ridge 204 may be greater than the corresponding width or other dimension of the others ridges 204 and only one corresponding channel 208 may be wide or otherwise large enough to receive the wider or otherwise larger ridge 204.

Figure 3:
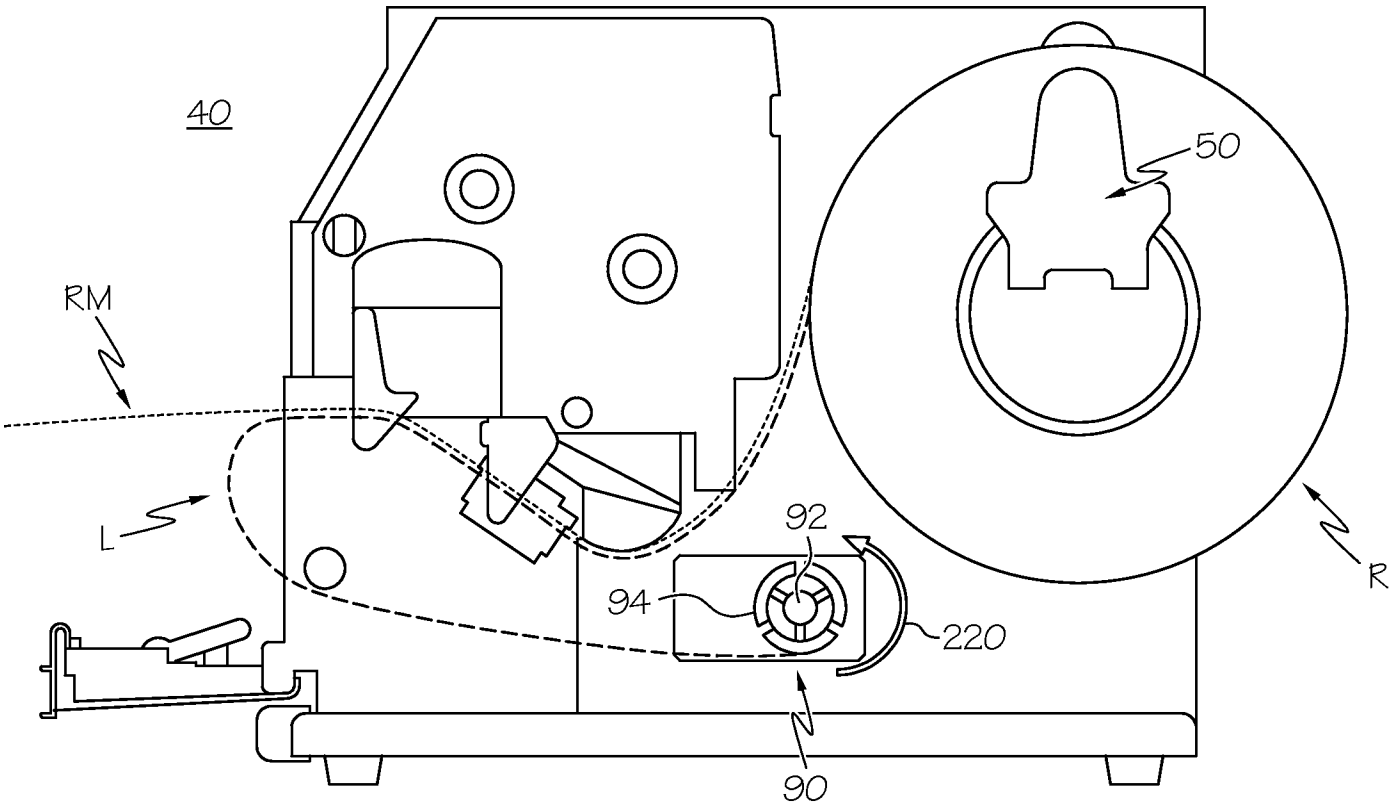
FIG. 3 is an abstract side view of the printer illustrated in FIG. 1, showing a supply roll of print media and a suitable routing of the print media through the printer.

In any event, as shown in FIG. 3, to start the liner on the take-up assembly 90, a free end and/or leading edge of the spent liner L is initially inserted through the gap or slot 212 of an empty core 94 and into the trough 216 of the spindle 92 on which the empty core 94 is carried. In this manner, the free end and/or leading edge of the spent liner L is initially held and/or retained by the take-up assembly 90. As successive labels or record members RM are dispensed from the printer 40 and additional spent liner L accumulates, the motor 100 is energized to rotate the spindle 92 and hence the core 94 in the direction indicated by the arrow 220 (see also FIG. 7). Accordingly, the spent liner L is wound around an outer circumference or periphery 210 of the core 94.

The gap or slot 212 formed in the wall of the core 94, is angled with respect to a radial direction extending from a central longitudinal axis of the core 94 (i.e., its axis of rotation). In particular, opposing surfaces 212' and 212" define the gap or slot 212 therebetween. These surfaces 212' and 212" are essentially parallel to one another. With respect to a radius drawn from the central longitudinal axis of the core 94 in a plane normal to that axis, each surface 212' and 212" obliquely intersects that radius. In particular, the surfaces 212' and 212" are slanted or inclined from the radius in or toward the direction of rotation of the core 94. In other words, the gap or slot 212 is formed so that a first opening is defined at the outer circumference or periphery 210 of the core 94 between the surfaces 212' and 212" and a second opening is defined at the inner surface 202 of the core 94 between the surfaces 212' and 212". Since the gap or slot 212 is made at an angle with respect to the radial direction, the aforementioned first and second openings are off-set from one another with respect to the direction of rotation of the core 94 (i.e., indicated by the arrow 220). In particular, with respect to the direction of rotation of the core 94, the first opening (at the outer circumference or periphery 210) leads or is ahead or in front of the second opening (at the inner surface 202). Suitably, by angling the gap or slot 212 in this manner, the initial hold or grip on the liner L may be beneficially strengthened.

Figure 8:
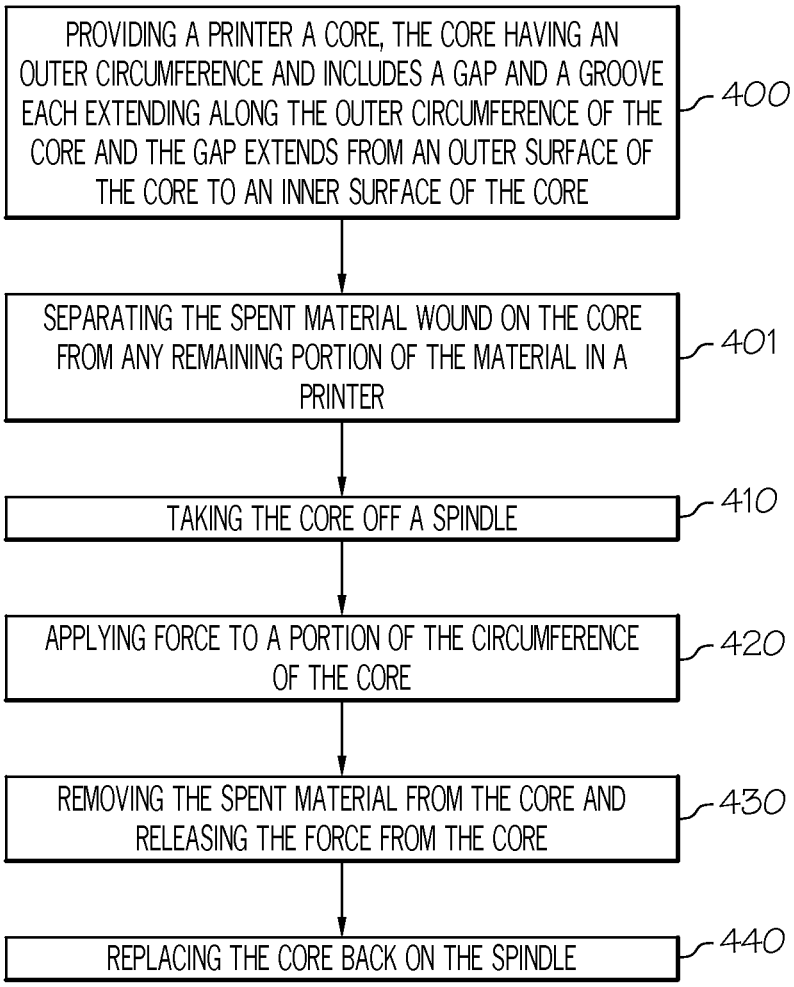
FIG. 8 illustrates a method for discarding spent material from a core of a take-up assembly of the present invention.

Optionally, a sensor or suitable detector or other means is used to measure or monitor the length or other amount of liner or other material which is wound onto the core 94. In one suitable embodiment, the back or counter EMF (electromotive force) experienced by the motor 100 is detected and/or monitored, which in turn is representative of or can otherwise be ultimately related to the amount of material wound on the core 94. In any event, when the core 94 has reached its capacity or the length or amount of spent liner L wound around the core 94 otherwise meets or exceeds a threshold limit, operation of the printer 40 is suitably halted or suspended. Suitably, a user is alerted or notified of the condition by an appropriate output on a user interface 300 of the printer 40, e.g., via lighting or display of an icon or error message or other visual signal, providing an audible signal, etc. Accordingly, the user is prompted to discard or otherwise remove the spent liner from the core 94. In practice, the user may selectively discard the accumulated spent liner as follows. For example, the user would as illustrated in FIG. 8:

provide a printer having a core, the core having an outer circumference and includes a gap and a groove each extending along the outer circumference of the core and the gap extends from an outer surface of the core to an inner surface of the core (400);

cut, tear or otherwise separate the spent liner L wound on the core 94 from any remaining portion of the liner L in the printer 40 (401);

take the full core 94 off the spindle 92 by sliding it axially therefrom (410);

squeeze or otherwise apply radially inward force to an exposed portion of the outer circumference or periphery 210 of the core 94, thereby reducing the outer circumference or periphery 210 of the core (420). This is accomplished by the gap 212 compressing and the groove 214 expanding thereby allowing the circumference of the core to reduce in diameter;

remove the spent liner from the core 94 by sliding it axially off an end of the core 94, and releasing or otherwise ceasing to apply the radially inward force to the core 94, thereby allowing the core 94 to resume its natural or at rest dimensions (430);

replace the now empty core 94 back on the spindle 92 (440);

re-engage the liner L with take-up assembly 90 by taking the free end or leading edge of the liner and placing it through the gap or slot 212 into the trough 216; and then, resume operation of the printer 40.

Suitably, the core 94 and spindle 92 disclosed in the present application are optionally formed and/or interact with one another in the same or similar fashion and/or include the same or similar features as the core and spindle combination described in U.S. Pat. Nos. 5,833,377 and 5,947,618, except as otherwise noted or described herein. Moreover, while the present core 94 and spindle 92 are disclosed herein as a take-up mechanism for receiving spent liner material, it is to be understood that they may likewise be employed as the take-up mechanism for receiving any web of material, including, e.g., used ink ribbon. Additionally, in appropriate applications, they may be used as a mechanism for supplying rolled webs of material.

In any event, it is to be appreciated that in connection with the particular exemplary embodiment(s) presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof.

What is claimed is:

1. A reusable and collapsible core for a printer, comprising:

a core that-includes a hollow member that has a bore that fits over a spindle, the core has a first end and a second end and a circumference wherein the core is formed of a deformable resilient material and is deformable along the at least one axially extending groove;

a wall formed on the hollow member, the wall having an interior and exterior surface;

at least one axially extending ridge formed on the interior surface of the wall of the core;

at least one gap formed in the wall and extending from the exterior surface to the interior surface of the hollow member and extending axially from the first end to the second end of the core; and at least one axially extending relief groove formed on the exterior surface of the wall of the core wherein the at least one gap and the at least one axially extending relief groove are disposed substantially equally around the circumference of the core such that there is about equal space between each the gap and at least one groove.

2. The core of claim 1, wherein the at least one groove extends an entire length of the core.

3. The core of claim 1, wherein the core is provided with two axially extending relief grooves and the grooves and the gap are disposed at regular intervals around the circumference of the core.

4. A printer, comprising:

a frame having a vertical wall and a floor;

a housing pivotally joined at hinges;

a roll of print media held by a media supply roll mounting assembly and mounted on the vertical wall of the frame;

a printhead assembly;

a take-up assembly having a spent liner take-up spindle and a collapsible core, the core includes a hollow member having a bore and has a circumference wherein the core is formed of a deformable resilient material and is deformable along the at least one axially extending groove, a wall having an interior and exterior surface and a at least one gap formed in the wall and extending from the exterior surface to the interior surface of the wall, at least one axially extending ridge formed on the interior surface of the wall of the core, and at least one axially extending relief groove formed on the exterior surface of the wall of the core wherein the at least one gap and the at least one axially extending relief groove are disposed substantially equally around the circumference of the core such that there is about equal space between each the gap and at least one groove.

5. The printer of claim 4, wherein the gap and the at least one groove extend a length of the wall.

6. The printer of claim 4, wherein the media supply roll mounting assembly is selectively pivotable.

7. The printer of claim 4, wherein the housing comprises two pieces.

8. The printer of claim 4, wherein the print media is label stock which includes a series of individual labels or record members releaseably adhered to a continuous web of material.

9. The printer of claim 4, wherein the take-up assembly is mounted to the vertical wall of the frame.

10. The printer of claim 4, further comprising an ink ribbon supply spindle and an ink ribbon take-up spindle.

11. The printer of claim 4, wherein the printer further comprises a detector to measure or monitor an amount of material wound onto the core.

12. A method of discarding spent material from a core of a take-up assembly of a printer, comprising the steps of:

providing a printer having a collapsible core, the core having a circumference an outer circumference and includes at least one gap and a groove each extending along the outer circumference of the core and the gap extends from an outer surface of the core to an inner surface of the core wherein the at least one gap and the at least one axially extending relief groove are disposed substantially equally around the circumference of the core such that there is about equal space between each the gap and at least one groove;

separating spent material wound on the core from any remaining portion of print material in the printer;

taking the core off of a spindle;

applying force to a portion of the circumference of the core;

compressing the gap to reduce a diameter of the core which includes expanding the groove;

removing the spent material from the core and releasing the force from the core; and replacing the core back on the spindle.

13. The method of claim 12, further comprising re-engaging the material with the take-up assembly and resuming operation of the printer.

14. The method of claim 12, wherein the material is used ink ribbon.

15. The method of claim 12, wherein the material is spent release liner.

* * * * *